US005568245A

United States Patent [19]

Ferber et al.

[11] Patent Number: 5,568,245

[45] Date of Patent: Oct. 22, 1996

[54] TURNOVER DEVICE FOR WEB-SHAPED RECORDING MEDIA

[75] Inventors: Otto Ferber, Germering; Vilmar Eggerstorfer, Poing, both of Germany

[73] Assignee: Siemens Nixdorf Informationssysteme AG, Paderborn, Germany

[21] Appl. No.: 465,249

[22] Filed: Jun. 5, 1995

[30] Foreign Application Priority Data

Aug. 19, 1994 [EP] European Pat. Off. ..... 94112973

[51] Int. Cl.[6] ..... G03G 15/00

[52] U.S. Cl. ..... 355/309; 101/223; 226/197; 355/319

[58] Field of Search ..... 355/308, 309, 355/319, 207; 347/153, 154; 226/197, 108; 242/538.2, 538.3

[56] References Cited

U.S. PATENT DOCUMENTS

| | | | |
|---|---|---|---|
| 1,173,278 | 2/1916 | Kellogg | 101/223 X |
| 3,906,855 | 9/1975 | Laursen | 101/223 |
| 4,014,609 | 3/1977 | VerSchage et al. | 355/319 X |
| 4,609,279 | 9/1986 | Hausmann et al. | 355/308 |
| 4,610,198 | 9/1986 | Raymond | 101/223 |
| 4,855,787 | 8/1989 | Hashimoto et al. | 355/319 X |
| 4,889,269 | 12/1989 | Long et al. | 226/197 |
| 5,410,384 | 4/1995 | Wächtler | 355/319 X |
| 5,467,179 | 11/1995 | Boeck et al. | 355/309 |

FOREIGN PATENT DOCUMENTS

| | | |
|---|---|---|
| 1243907 | 11/1988 | Canada . |
| 0154695 | 9/1985 | European Pat. Off. . |
| 0191592 | 8/1986 | European Pat. Off. . |

OTHER PUBLICATIONS

*Xerox Disclosure Journal*, vol. 9, No. 3, May/Jun. 1984, pp. 201–203.

Sanders, "Two–Path Electrophotographic Print Process", *IBM Technical Disclosure Bulletin*, vol. 22, No. 6, Nov. 1979, pp. 2465–2466.

*Patent Abstracts of Japan*, vol. 17, No. 191 (M–1396) 14 Apr. 1993 of JP4339679.

*Primary Examiner*—Arthur T. Grimley
*Assistant Examiner*—Sophia S. Chen
*Attorney, Agent, or Firm*—Hill, Steadman & Simpson

[57] ABSTRACT

A turnover device is provided having a W-shaped arrangement of hollow rod-like deflector rods and reverser rods with an automatic threading device. The turnover device receives continuous paper in an admission slot, self-threads the paper therethrough, and returns the paper through a discharge slot in a flipped-over manner for use with a multi-functional, electrographic printer device for printing a web-shaped recording medium in simplex and duplex printing. The rods are preferably hollow with air holes to provide an air cushion between the rod and paper. Guide channels are also preferably disposed over each rod to guide the paper thereover.

19 Claims, 13 Drawing Sheets

TURNOVER DEVICE FOR WEB-SHAPED RECORDING MEDIA

BACKGROUND OF THE INVENTION

The present invention is generally directed to a turnover device for web-shaped recording media arranged inside an electrographic printer or copier.

With respect to modern electrographic printer systems, highly economical usage and broad flexibility are increasingly demanded by customers. Both the effective utilization of printing materials as well as the flexible design of the print information thereby play an important part.

Continuous-processing (fan-fold) electrographic printing systems capable of one-sided printing on a web-shaped recording medium have prevailed in the marketplace where high availability of the apparatus given large printing volume and a broad spectrum of printing materials are required. These printer systems, however, are disadvantageous in that they cannot be switched between single-sided (simplex) and double-sided (duplex) printing. This leads to an unfavorable economic situation for the user and also runs contrary to contemporary ecological demands to efficiently utilize raw materials. Many customer-associated demands that necessarily require double-sided printing (brochures, books, etc.) can thus not be satisfied, particularly since electrographic high-performance printers are especially efficient when operated without interruption.

For producing multi-color and backside printing with electrographic printer devices that process continuous stock, EP-B1-01 54 695 discloses that two continuous stock printers operated following one another, whereby the paper printed in the first printer is turned over and is subsequently printed on the second side in the second printer. The outlay is substantial due to the requirement of a second printer.

The reference IBM Technical Disclosure Bulletin, Vol. 22, No. 6, Nov. 1979, pp. 2465-2466 also discloses an electrophotographic printer device for printing web-shaped recording media with which it is possible to print the recording medium on both sides. To this end, the recording medium is taken down from a supply stack, is supplied to a transfer printing station and is provided with toner images on one side. After being fixed, the recording medium is turned over with the assistance of a turning mechanism composed of deflection rods and is resupplied to the transfer printing station. After printing the backside of the recording medium with toner images, fixing is again carried out in the fixing station.

This reference basically discloses duplex printing with continuous stock media. The proposal, however, never led to a product. Further, this electrographic printer device is suited only for both-sided printing of the recording medium. A change in operating modes is not provided. The turnover means composed of deflection rods that is employed requires manual threading of the recording medium. Moreover, the nature of the arrangement of the deflection rods requires a great deal of integration space.

It is therefore an object of the present invention to provide a turnover means for web-shaped recording media that enables an automatic threading of the recording medium.

Another object of the invention is to fashion the turnover means such that it can be arranged integrated in user-friendly fashion in an electrographic printer means with which single-sided and both-sided printing of a web-shaped recording medium is possible.

SUMMARY OF THE INVENTION

These goals of the invention are achieved by providing a turnover device for turning over a web-shaped recording media. The device has a paper admission channel and a paper discharge channel arranged next to each other. A first oblique deflector laterally deflects the recording medium supplied through the paper admission channel. A first reverser is arranged following the first oblique deflector in paper conveying direction for returning the recording medium behind the paper channels toward a second reverser arranged approximately parallel to the first reverser, the second reverser again reversing the recording medium. A second oblique deflector is provided following the second reverser, the second oblique deflector deflecting the recording medium into the paper discharge channel. The turnover device further includes a threader for the threading the recording medium through the turnover device. The threader has a motor-driven gripper element guided around the reversers. The gripper element grips the start of the recording medium, whereby a start of the recording medium is seized in the region of the first oblique deflector, and guided around the reversers and the second oblique deflector and up into the region of the paper discharge channel.

In an embodiment, the gripping element is a friction element. Also, in an embodiment, the threader includes a conveyor belt that wraps the reversing devices, the friction device being disposed at an inside of the belt.

In an embodiment, the friction element has a length such that the friction element is disengaged from the recording medium in an operating position at which the friction element is located between the oblique deflector devices.

In an embodiment, each oblique deflector and reverser is elongated or rod-like and has a smooth deflector surface over which the recording medium glides. Each deflector surface is faced by a concave guide surface at a distance. A deflection channel is defined between the deflector surface and guide surface.

In an embodiment, at least one guide surface is hingeably mounted to provide access to the respective deflector surface.

In an embodiment, air exit openings are arranged in the region of the deflection surfaces, the openings being in communication with an air supply. In a related embodiment, each oblique deflector and reverser comprises a hollow tubular member with a hollow portion, the hollow portions being coupled in fluid communication with one another and to the common air supply.

In an embodiment, a recording medium circulation channel is provided around the reversers. A shunt is associated with each deflector for guiding the recording medium at toward the respective deflector. The gripper element is guided in a recording medium circulation channel extending between the reversers.

In an embodiment, the gripper element, such as a friction pad made of foam or silicon, is guided around the reversers over a conveying path that is longer than a conveying path of the start of the recording medium so that the start of the recording medium leads relative to the gripper element when circulating around the reversing devices.

In an embodiment, a plurality of paper conveyor elements are provided. At least one is arranged in the paper admission channel, conveying the start of the recording medium to the first oblique deflector device. At least one other is arranged in the discharge channel conveying the start of the recording medium from the second oblique deflector device to the discharge channel.

In an embodiment, a conveyor element is arranged downstream from the second oblique deflector, such as a friction wheel for engaging the web to transport it through the discharge slot.

In an embodiment, a first sensor senses the position of the gripper element. A second sensor senses a presence of the recording medium near the first oblique deflector. A threading control arrangement operably coupled with the sensors and the recording medium conveyor means controls threading of the start of the recording medium. The controller causes the start of the recording medium to be seized when sensed by the second sensor in the region of the first oblique deflector device, activating the threading of the recording medium until the start of the recording medium extends into the paper discharge channel. The gripper element is then positioned in a quiescent position where it is disengaged from the recording medium.

In an embodiment, the turnover device is an independent module removably mounted on a displaceable mount.

In an embodiment, the turnover device is arrangable in an electrographic printer for printing web-shaped recording media. An intermediate carrier is provided with appertaining units producing toner images on the intermediate carrier. A transfer printing station is associated with the intermediate carrier and accepts the recording medium. A fixing station follows the transfer printing station in a conveying direction of the recording medium fixing the toner images on the recording medium, the intermediate carrier, transfer printing station and fixing station each has a useable width at least twice a web width of the recording medium. The turnover device is arrangable to receive the recording medium from the fixing station and to provide the recording medium to the transfer printing station from the paper discharge channel.

In an embodiment, the paper admission channel receives the recording medium from a recording medium output channel. The output channel has a width of at least twice a web width of the recording medium. The recording medium is driven via paper conveyor elements.

In an embodiment, a turnover device is provided for a turning over a continuous paper conveyed in a generally longitudinal direction. The turnover device includes a paper admission slot through which the paper is delivered and a paper discharge slot parallel to the paper admission slot and is axially disposed therewith. The device further includes a W-shaped rod arrangement having:

- a first deflector rod arranged at approximately forty-five degrees from the paper admission slot, the paper being conveyed from the admission slot gliding over the deflector rod and away therefrom so that the paper changes direction at a right angle;
- a first reverser rod arranged at a first side of the turnover device approximately ninety degrees from the admission slot, the first reverser rod receiving the paper from the first deflector rod, the paper gliding around the first reverser rod and reversing its direction;
- a second reverser rod arranged parallel to the first reverser rod at an opposite side of the turnover device, the second reverser rod receiving paper conveyed from the first reverser rod, the paper gliding over around the second reverser rod and reversing its direction;
- a second deflector rod arranged approximately forty-five degrees from the admission slot, the paper conveyed from the second reverser rod gliding over the second deflector rod and away therefrom so that the paper changes direction at a right angle, paper being conveyed away from the second deflector rod through the discharge slot, the paper exiting the discharge slot in a flipped over manner relative to the paper entering the admission slot.

Moreover, the device includes a threader with a conveyor belt extending in a continuous manner around the first and second reverser rods. A gripping pad is disposed on an inner side of the conveyor belt to engage and convey the paper from the first deflector rod, around the first and second reverser rods, to the second deflector rod. A guide channel is disposed over each deflector rod and reverser rod for guiding the paper over the associated rod.

In an embodiment, a hollow cavity is disposed within at least one of the rod. Air holes are disposed through the rod in association with each hollow cavity. The air holes are in communication with an air supply and thereby form an air pillow between the rod and the paper.

In an embodiment, the turnover device also includes a threader controller, a first sensor sensing a presence of the paper inserted near the first deflector rod, and a second sensor sensing the position of the friction pad. The controller activates the conveyor belt in response to a signal from the first sensor, causing the paper to be conveyed through the turnover device and threaded around the rods. The friction pad is stopped in a quiescent position not engaging the paper after the paper has been threaded to the discharge slot.

Deflector elements arranged in the shape of the letter W in combination with a motor-driven, circulatory grab element provide advantages of a compact and reliable structure of a turnover device having automatic threading of the recording medium.

The turnover means can be employed both between two separate devices as well as integrated in one device. As a result of its compact fashioning as a self-supporting, displaceably suspended structural unit, it is especially suited for integrated arrangement in multi-functional electrographic printer systems that, as a consequence of their structure, can print continuous stock both on one side as well as on both sides, in a single color or multi-color.

In such a multi-functional electrographic printing system, transfer printing station and fixing station have a useable width of at least twice the web width of the recording medium, whereby each of these units is traversed twice by the recording medium in duplex mode, namely parallel side-by-side. The turnover means is thereby arranged following the fixing station and can be coupled to the transfer printing station via the paper discharge channel. The turnover means thus has two jobs: first, it turns the recording medium over by 180°; on the other hand, it displaces the recording medium leaving the fixing station laterally by the width of one recording medium so that the following transfer printing station and the fixing station can in turn be traversed parallel again.

The employment of deflector elements in the form of hollow rods that are connected to one another enables an integrated air guidance in order to generate an advantageous friction-reducing air pillow in the region of the sliding surfaces of the deflector elements.

Upon insertion of the structural unit into the printer, an automatic connection of the electrical and pneumatic supply of the turner ensues.

In order to assure accessibility of the turner given malfunctions in the paper running and in order to be able to easily clean the turner, the paper guide surfaces are hingeably fashioned, particularly in the region of the deflector elements.

It is also beneficial to employ a conveyor belt guided around the outer turner elements and comprising a friction coat at its inside as a threading element. While operating the printer with the recording medium inserted in the turnover means, the friction coat is positioned between the oblique deflector elements such that it is disengaged from the recording medium. In the region of the lateral deflector elements, the conveyor belt is guided at a distance around the gliding surfaces thereof, however, the recording medium glides along at the glide surfaces. The position of recording medium thus changes relative to the friction coat in a leading fashion. At the end of the threading process, it is thus possible to push the start of the recording medium via the back end of the friction coat far into the paper discharge channel wherein it is seized by paper transport elements.

Additional features and advantages of the present invention are described in, and will be apparent from, the detailed description of the presently preferred embodiments and from the drawings.

BRIEF DESCRIPTION OF THE DRAWINGS

Embodiments of the invention are shown in the drawings and shall be set forth in greater detail below by way of example.

DETAILED DESCRIPTION OF THE PRESENTLY PREFERRED EMBODIMENTS

Figure 1:
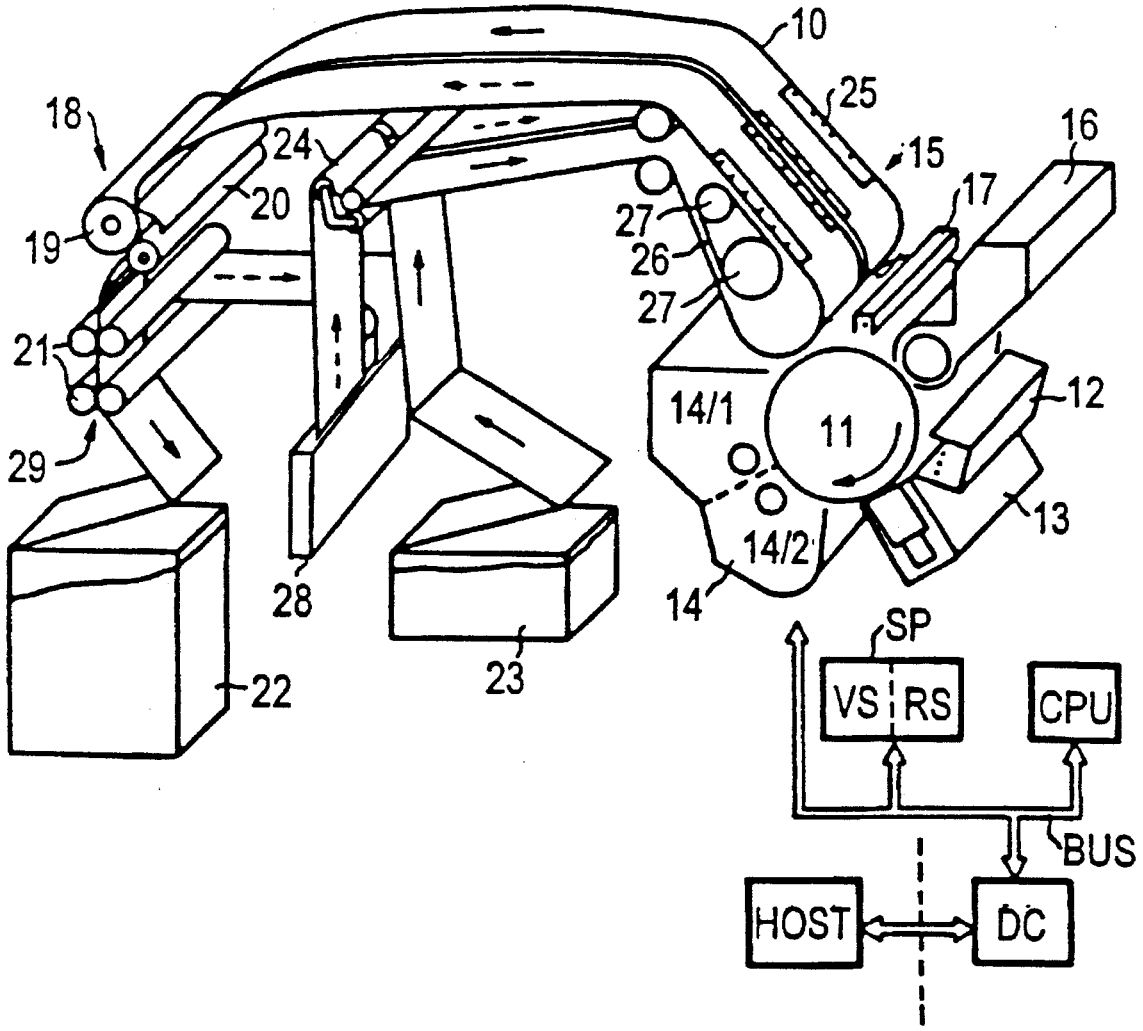
FIG. 1 is a schematic illustration of an electrographic printer means for printing web-shaped recording media in duplex operation.

An electrographic printer device for printing web-shaped recording media 10 having different web width contains an electromotively driven photoconductor drum as intermediate carrier 11. Instead of the photoconductor drum, however, a web-shaped intermediate carrier, for example an OPC band, can also be employed, as can a magneto-stylus arrangement, as disclosed, for example, by EP-B1-0 191 521. The various units for the electrophotographic process are grouped around the intermediate carrier 11. Essentially, these are: a charging means 12 in the form of a charging coroton for charging the intermediate carrier 11; a character generator 13 having a light-emitting diode comb for character-dependent exposure of the intermediate carrier 11 and that extends of the entire useable width of the intermediate carrier 11; a developer station 14 for inking the character-dependent charge image on the intermediate carrier with the assistance of a one-component or two-component developer mix; a transfer printing station 15 that extends over the width of the intermediate carrier 11 and with which the toner images are transferred onto the recording medium 10. For removing the residual toner after the development and the transfer printing, a cleaning station 16 is provided having cleaning brushes integrated therein and having an appertaining suction device as well as a discharge means 17. The intermediate carrier 11 is electromotively driven and is moved in arrow direction during print operation.

The printer device further contains a fixing station 18 arranged following the transfer printing station 15 in conveying direction of the recording medium, this fixing station 18 being fashioned as a thermoprinting fixing station having a heated fixing drum 19 with appertaining pressure drum 20, as well as guide rollers 21 following the fixing station that, among other things, serve as output elements for a stacker means 22 for the recording medium 10. Other fixing stations, for example having a heated or unheated admission saddle or a cold fixing station are also possible instead of the illustrated fixing station. The web-shaped recording medium 10 is fabricated, for example, as pre-folded continuous stock provided with margin perforations and is supplied to the transfer printing station via delivery rollers 24 proceeding from a supply region 23. However, it is also possible to supply a recording medium without margin perforations via a roller delivery.

The transport of the recording medium thereby preferably ensues via a conveyor means 25 that is allocated to the transfer printing station 15, such as conveyor belts with pins that, guided via drive shafts 27, engage into the margin perforations of the recording medium 10. When a recording medium free of transport holes is employed, it is within the capability of a person skilled in the art to provide adapted conveyor means that transport the recording medium, for example by friction, controlled by a control arrangement that senses synchronization marks. Further, a turnover means 28 is arranged in the housing region of the printer means between supply region 23 and the fixing station 18; the function of this turnover means 28 shall be set forth later and the recording medium is returned thereover from the fixing station 18 to the transfer printing station 15.

The printer means is controlled via a printer controller that is schematically shown here and comprises a central unit CPU, a page memory SP that is divided into memory areas page-dependent, as well as a data control unit DC. All units of the controller are connected to one another and to the units of the printer means via a bus system.

The electrographic printer mans is suitable for printing recording medium having different web widths. To this end, the intermediate carrier 11 (photoconductor drum) comprises a useable width that corresponds to the greatest possible recording medium width (for example, a format of DIN A3 broadside). This width corresponds to twice the DIN A4 width. It is thus possible to arrange two DIN A4 recording medium widths longitudinally side-by-side in the region of the transfer printing station 15. The fixing station 18 and the other electrophotographic units such as developer station 14, character generator 13, cleaning station 16 are designed corresponding to this useable width. An adaptation of the width of the character generator 13 to different recording medium widths requires no mechanical modification at the character generator when, as in this case, a LED character generator is employed comprising a plurality of LEDs arranged in rows. An adaptation to the recording medium width being employed ensues electronically by selection.

For matching the conveyor means or belt 25 to different recording medium widths, the conveyor means can be fashioned width-adjustable. This, for example, can be achieved in that the drive wheels that carry the conveyor belts (nubbed belts) that engage into the margin perforations of the recording medium are displaceably seated on polygonal shafts.

When two narrow recording media are arranged and conveyed side-by-side in the region of the transfer printing station 15, then it is normally sufficient to provide a conveyor means only for the margin perforations that respectively lie at the outside. Given an appropriate design, it is therefore possible to employ the same conveyor belts for the broad recording medium and for the two narrower recording media without having to adjust these conveyor belts. If it is nonetheless necessary to guide the recording media at both sides, then separate transport elements that engage into the margin perforations of the recording media can be centrally arranged for operation with the two narrow recording media arranged side-by-side. So that these transport elements do not represent a disturbing factor given operation with only one broad recording medium, they can be arranged pluggable and unpluggable or pivotable or, on the other hand, it is possible to provide the drive wheels 27 of the conveyor belt 25 with retractable and extendable pins or, respectively, nubs.

The turnover means 28 arranged in a return channel for narrow recording media from the fixing station 18 to the transfer printing station 15 serves the purpose of turning between front and back sides of the recording medium. It is fashioned switchable dependent on operating mode and comprises an automatic threading means for the recording medium.

For both-sided, single-color printing of a narrow recording medium in duplex mode, as shown in FIG. 1, the narrow recording medium, for example a recording medium having the width of DIN A4, is supplied to the transfer printing station 15 via the delivery rollers 24 proceeding from the supply region 23 and is printed with the front side toner image on its top side. The front side of the recording medium 10 is thereby identified by solid transport arrows and the bottom side is identified by broken-line transport arrows. After this, the recording medium having the front side toner image is supplied to the fixing station 18 and the front side toner image is fixed. Further-conveying of the recording medium to the turnover means 28 whose deflection contour is positioned in a turnover position ensues via the guide rollers 21. The recording medium is turned over with respect to its front and back sides in the turnover means 28 and is resupplied to the transfer printing means 15 via the delivery rollers 24 such that its backside can be provided with a backside toner image. After this, the recording medium is again supplied to the fixing station 18 and the backside toner image is fixed and the recording medium printed on both sides is subsequently deposited in the stacking means 22.

Since the front side and backside toner images are produced at different times and are transfer-printed onto the recording medium, a corresponding data editing via the printer controller is necessary. To this end, the page memory SP contains memory areas VS for storing front side image data and memory areas RS for storing the backside image data. The data editing thereby ensues via the data control means DC, whereby the data proceeding from a data source (host), for example an external data store, are supplied to the data control means DC via an interface. The data of the individual pages to be printed are thereby deposited in the page memory SP, namely separated according to front side VS and backside RS into the corresponding memory areas. The fetching of the data then ensues temporally controlled, so that the desired front side/backside allocation of the toner images on the recording medium is achieved.

TURNOVER MEANS

The turnover means 28 (FIG. 3) essentially contains four deflector elements arranged in the fashion of the letter W via which the recording medium 10 is conducted up to a paper discharge channel 31 proceeding from a paper admission channel 30. The paper admission channel 30 and paper discharge channel 31 are thereby arranged side-by-side in one plane.

A recording medium 10 supplied via the paper admission channel 30 is first conducted over a first oblique deflector 32 that laterally deflects the recording medium. This deflector 32 is composed of a hollow deflector rod 33 or drum arranged at approximately 45° relative to the paper running direction. The first oblique deflector 32 is followed in paper conveying direction by a first reverser 34 comprising a reverser rod reversing deflector element 35 in the form of a hollow profile. The first reverser 34 returns the recording medium 10 behind the paper channels up into the region of a second reverser 36 arranged approximately parallel to the first reverser 34 that again reverses the recording medium 10. A second reverser 36 likewise comprises a rod or deflector 35 in the form of a hollow profile. The second reverser 36 is followed by a second oblique deflector 37 that deflects the recording medium 10 into the paper discharge channel 31 and that has a hollow deflector rod 33 or drum arranged at approximately 45° relative to the paper running direction.

Figure 3:
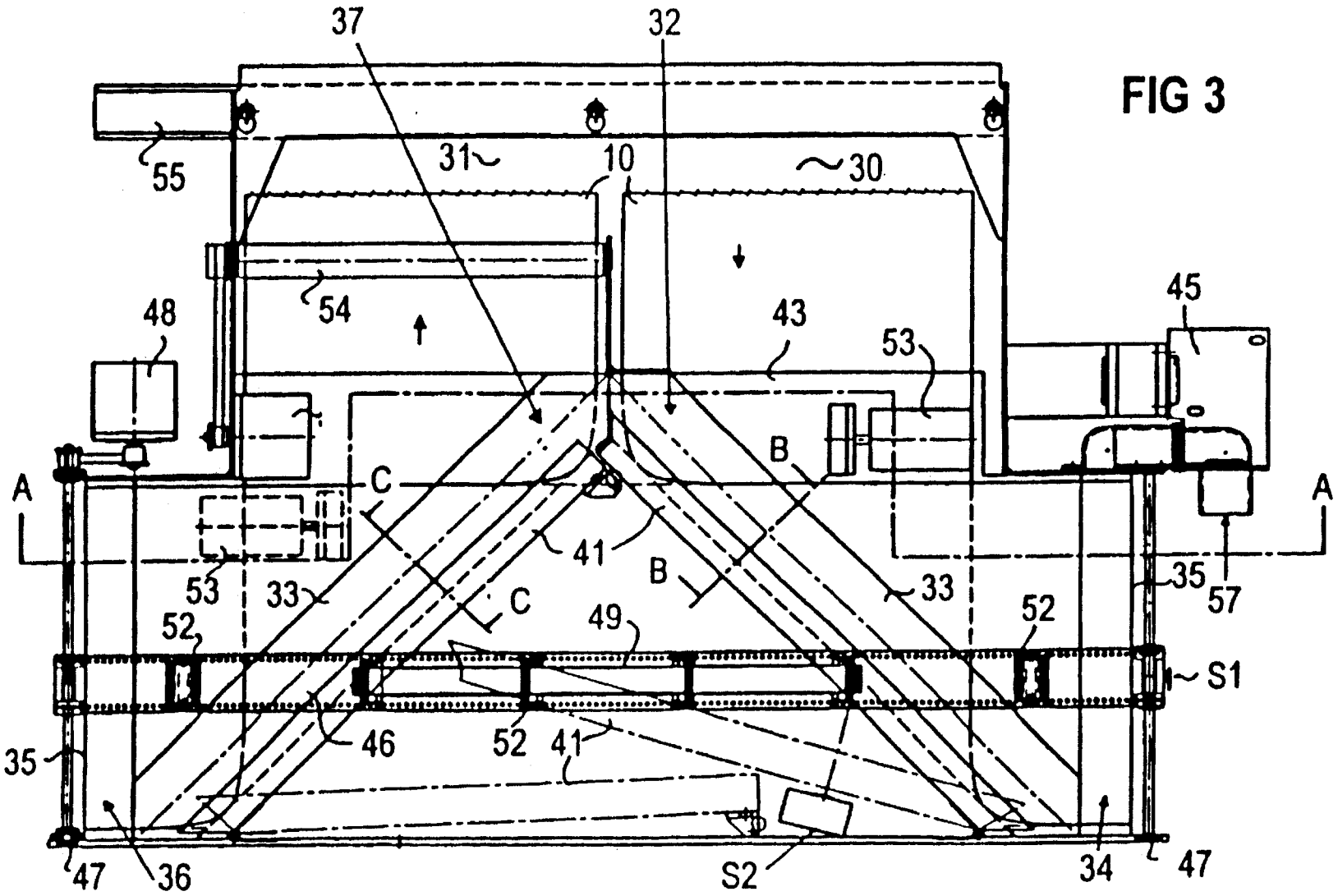
FIG. 3 is a schematic illustration of a turnover means arranged in the electrographic printer means.
Figure 4:
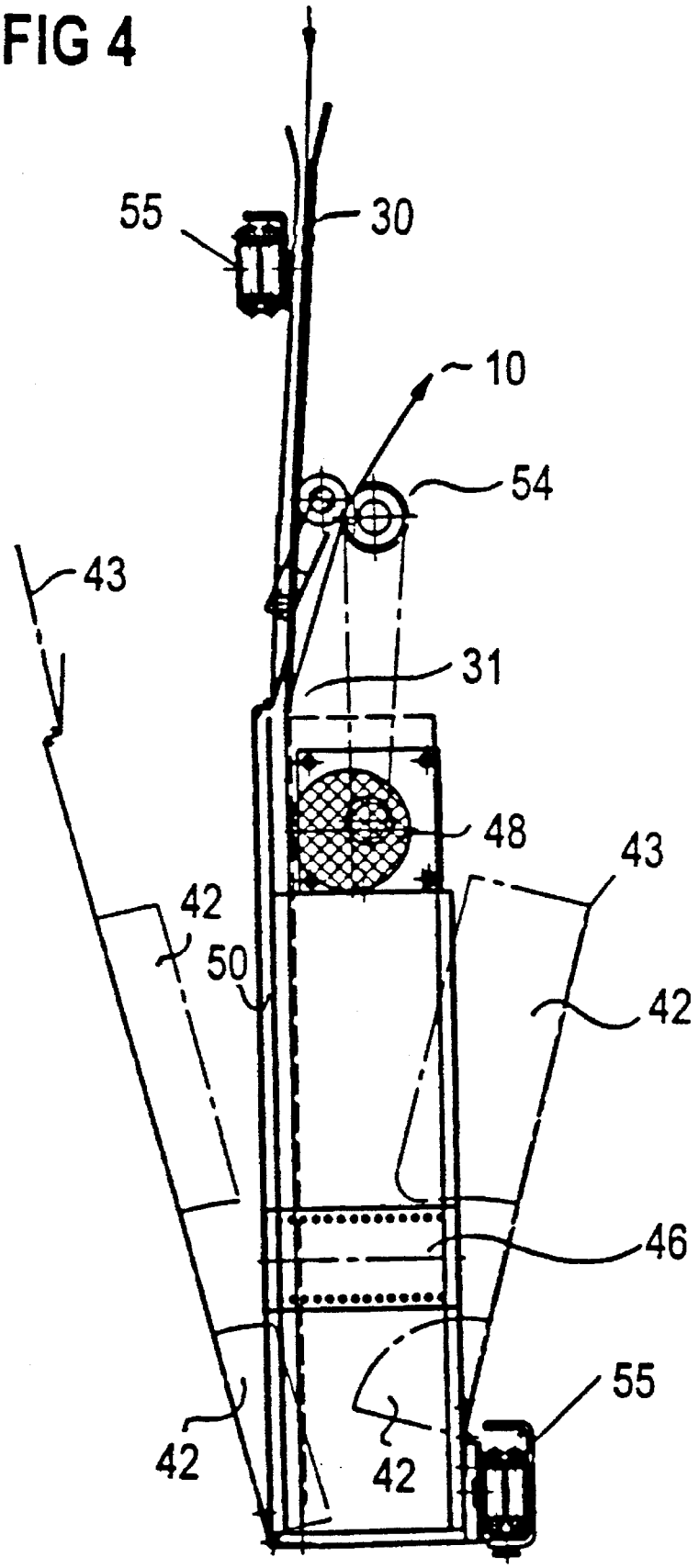
FIG. 4 is a schematic illustration of the turnover means arranged in the electrographic printer means, shown in a side view.
Figure 5:
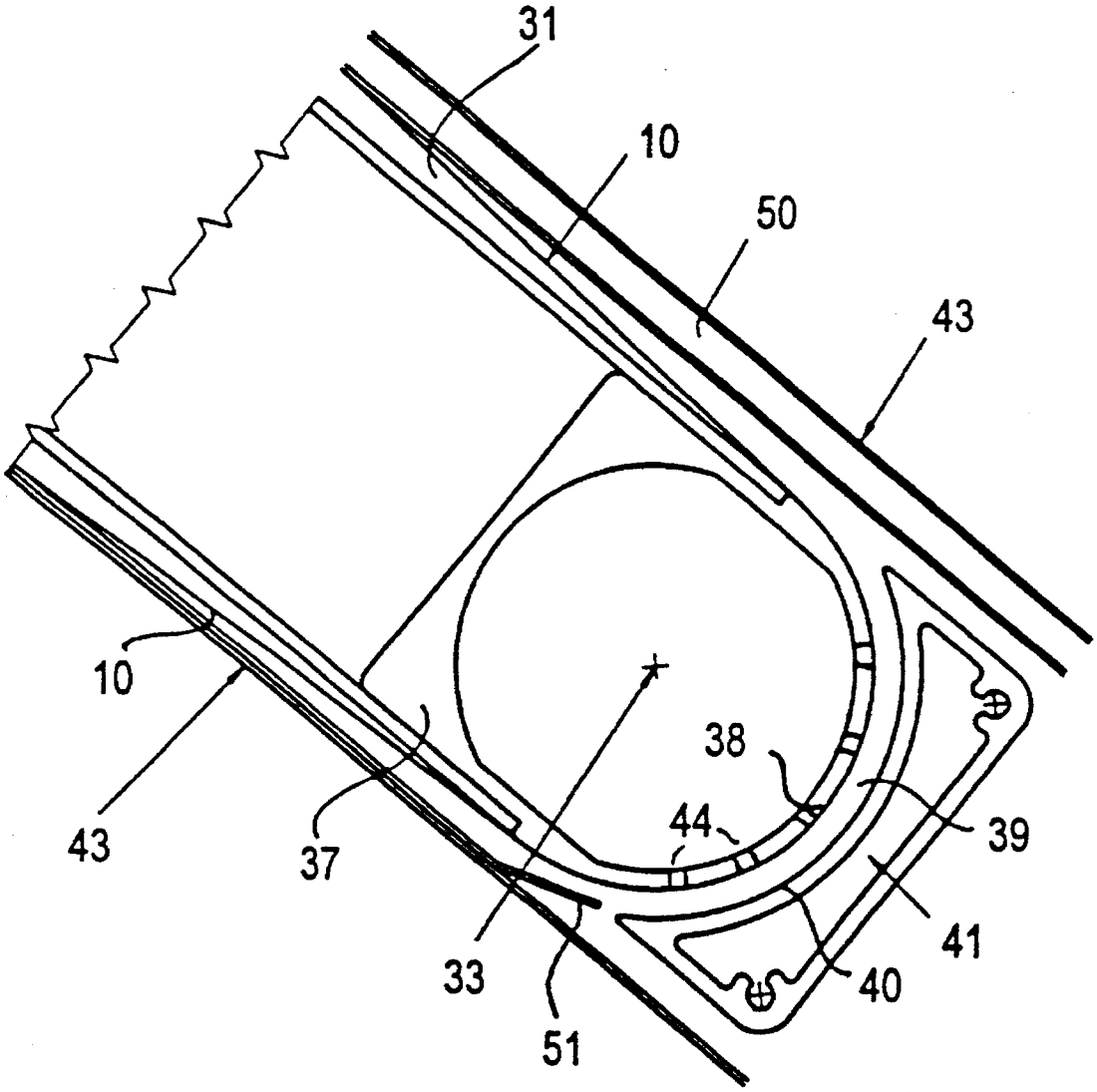
FIG. 5 is a schematic, sectional view of the paper guidance in the turnover means along the line of section C—C of FIG. 3.
Figure 6:
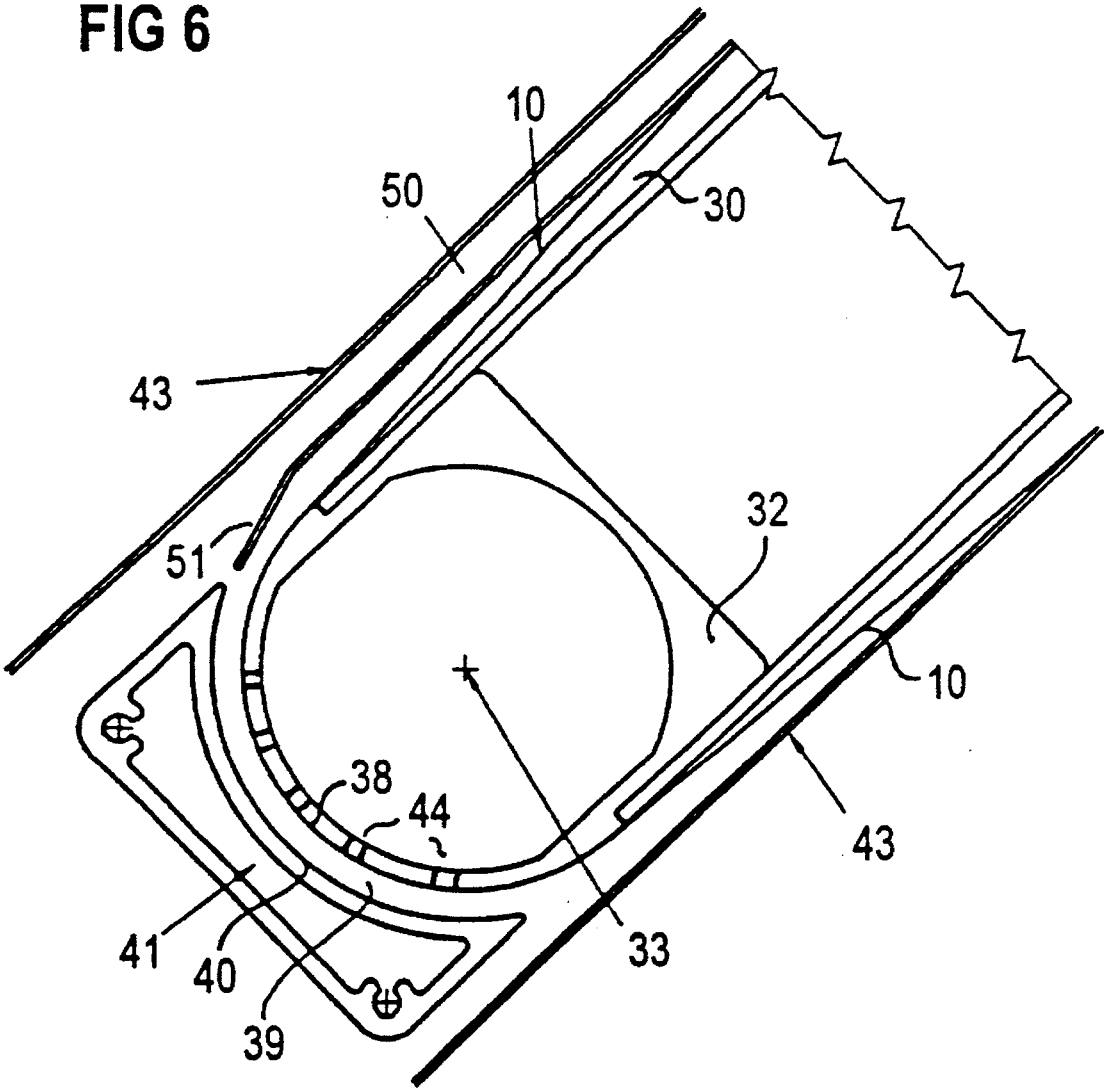
FIG. 6 is a schematic, sectional view of the paper guidance in the turnover means along the line of section B—B of FIG. 3.
Figure 7:
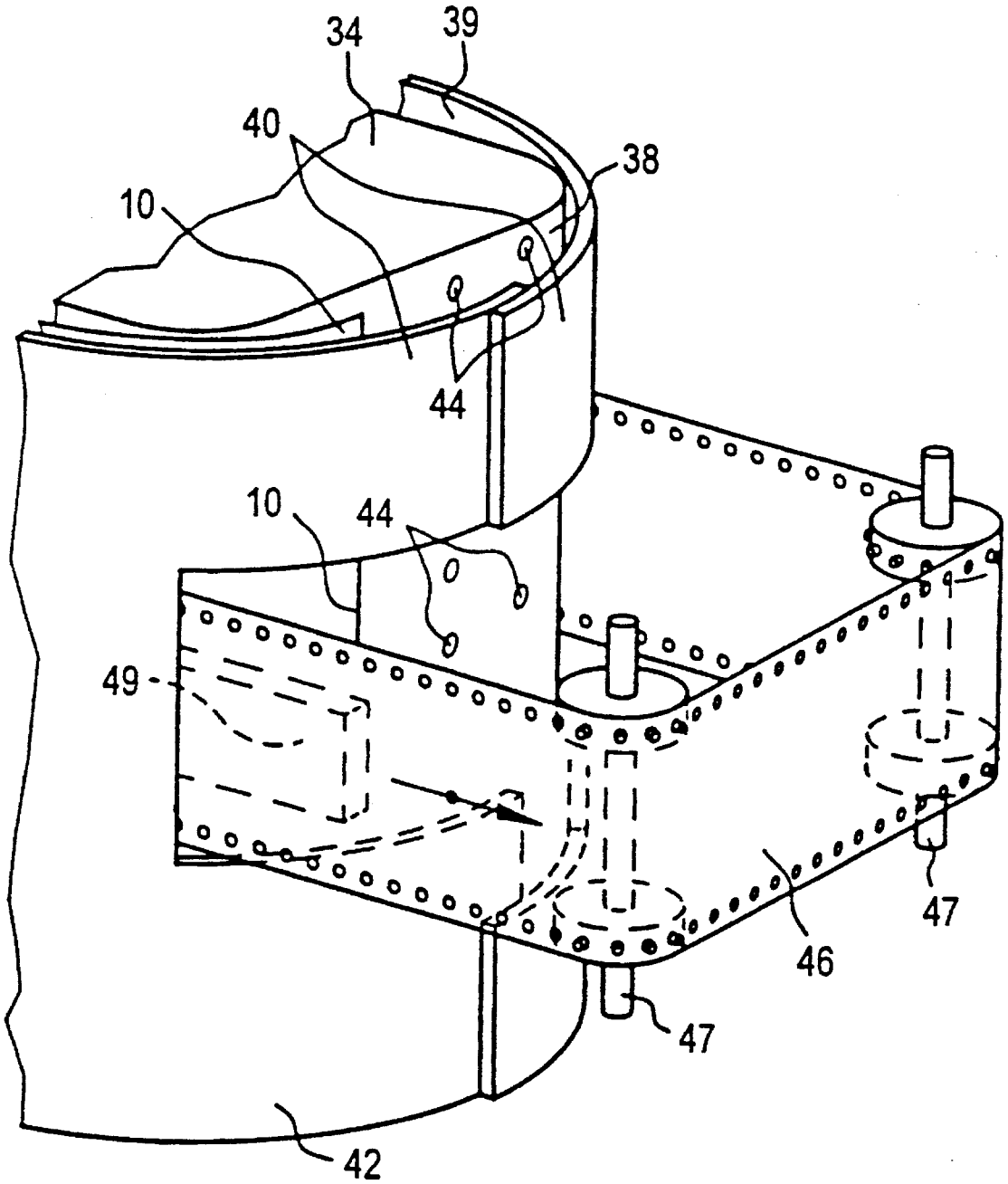
FIG. 7 is a schematic illustration of the paper guidance in the region of the lateral reversing devices.

As deflecting surfaces 38 (FIGS. 5, 6, 7), deflector rods 33 and deflectors 35 comprise elongated, wear-resistant, polished surfaces that serve as glide surfaces for the recording medium 10 and that are embraced by guide surfaces 40 at a distance therefrom that form a deflection channel 39. The guide surfaces 40 allocated to the deflector rods 33 of the oblique deflectors 32 and 37 are part of hingeably arranged flaps 41 composed of hollow profiles. They are shown in FIG. 3 in operating position (solid line) and in hinged-out position (broken lines). The guide surfaces 40 of the deflectors 35 are composed of spring steel sheets 42 that are arranged on front-side and back-side, hingeable housing flaps 43 of the turnover means. The housing flaps 43 are shown with broken lines in FIG. 4 in the hinged-out position.

In order to reduce the friction between glide surfaces and recording medium in the region of the deflection points, the deflection surfaces 38 comprise air exit openings 44 (FIGS. 5, 6, 7) via which an air pillow between recording medium and deflection surfaces can be produced, particularly during threading. The hollows of deflector rods 33 and deflectors 35 are in communication with one another and serve as air supply channels. A connector assembly 45 arranged in the acceptance region for the turn-over means in the apparatus can be coupled to the right-hand deflector 35 for the controlled delivery of blast air via a blower 57. It also contains a plug for electrical connection.

The turnover means further contains a threading mechanism for the recording medium 10 having a motor-driven gripper element guided around the reversing means 34, 36, the gripper element comprising grasping means for the start of the recording medium, whereby the start of the recording medium is seized in the region of the first oblique deflectors 32 for being threaded into the turnover means and is conveyed up into the region of the paper discharge channel 31 via the reversers 34, 36 and the second oblique deflector 37.

The gripper element in the illustrated exemplary embodiment is composed of a margin-perforated conveyor belt 46 that is guided around the reversers 34, 36 via guide axles 47. It is driven via a motor 48. A friction coat 49 (friction element) made of expanded cellular material or silicone is arranged at the inside of the conveyor belt 46. The length of said friction coat 49 is dimensioned such that the friction element 49 is disengaged from the recording medium 10 in the operating condition of the turnover means shown in FIG. 3 wherein the friction element 49 is located between the oblique deflectors 32, 37.

The turnover means 28 having allocated shunts 51 for introduction of the recording medium 10 into and removal of the recording medium 10 from the region of the oblique deflector means 32, 37 proceeds around the reversers 34, 36. A through guidance channel for the recording medium 10 around the deflectors 33, 35 from the paper admission channel 30 up to the paper discharge channel 31 thus fundamentally derives together with the deflection channels 39. The conveyor belt 46 enters into the channel sections of the recording medium circulation channel lying between the reversers 34, 36 and is guided therein. The channel walls facing toward the friction coat 49 comprise roller elements 52 (FIGS. 3, 9) in the region of the conveyor belts 46 for reducing the friction between recording medium 10 and wall surface. The recording medium 10 is clamped between the roller elements 52 and the friction coat 49 and is thus reliably conveyed by the friction coat 49.

In the region of the reversers 34, 36, the conveyor belt 46 is conducted over a conveying path (FIG. 7) that proceeds outside the deflection channel 39 as part of the recording medium circulation channel 50 and that is longer than the conveying path of the start of the recording medium through the deflection channel 39. The position of the recording medium 10 relative to the friction coat 49 thus changes in leading fashion when circulating around the reversers 34, 36. It is thus possible to push the start of the recording medium far into the paper discharge channel 31 via the back end of the friction coat 49 at the end of the threading procedure, the start of the recording medium being seized by paper conveyor elements 53 in the paper discharge channel 31. These paper conveying elements 53 can be composed of pivotable friction wheels or beater elements or tractors having conveyor lamellae. They are arranged in the region of the oblique deflector devices 32, 37 in the paper admission channel 30 and in the paper discharge channel 31, namely such that they engage at that side of the recording medium 10 that is free of toner images. An additional, motor-driven recording medium conveyor means in the form of paper conveying rollers 54 that serve the purpose of supplying the recording medium 10 to the return channel to the transfer printing station is also arranged downstream from the second oblique deflector device 37.

Figure 16:
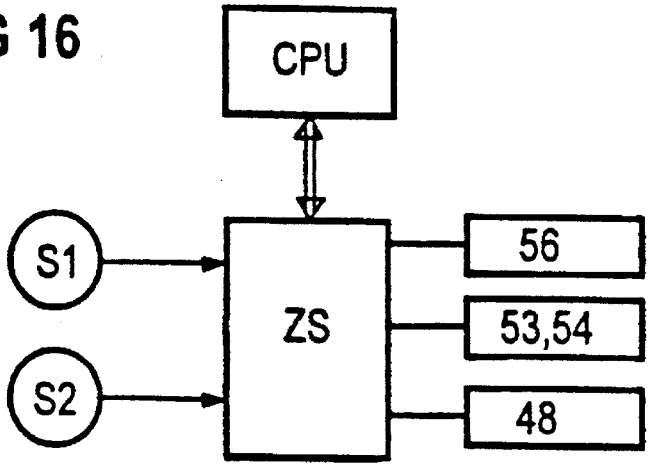
FIG. 16 is a block circuit diagram of a control arrangement for the turnover means.

The turnover means is controlled via a microprocessor-controlled threading control arrangement shown in FIG. 16 that can be part of the apparatus controller. It is composed of the actual central controller ZS containing a microprocessor. The input side thereof is in communication with an optical sensor S2 that is arranged under the first oblique deflector device 32 and that senses the start of the recording medium in the region of the first oblique deflector device 32 and is also in communication with a sensor S1 arranged in the region of the first reversing device 34 which can be fashioned as a Hall sensor and that senses the position of the friction element 49 (friction coat) via a magnet element. The threading control arrangement has its output side coupled to the blower for generating the blast air 56, to the drives for the paper conveying elements 53 and to the paper conveying rollers 54 and the conveyor belt drive 48. The threading control arrangement seizes the start of the recording medium in the region of the first oblique deflector 32 via the sensor S2 for the purpose of threading, activates the conveyor belt drive 48 dependent thereon, and, dependent on the position signal of the sensor S1 after the recording medium start has been threaded through into the paper discharge channel 31, positions the friction coat 49 in a quiescent position wherein it is disengaged from the recording medium 10.

Figure 17:
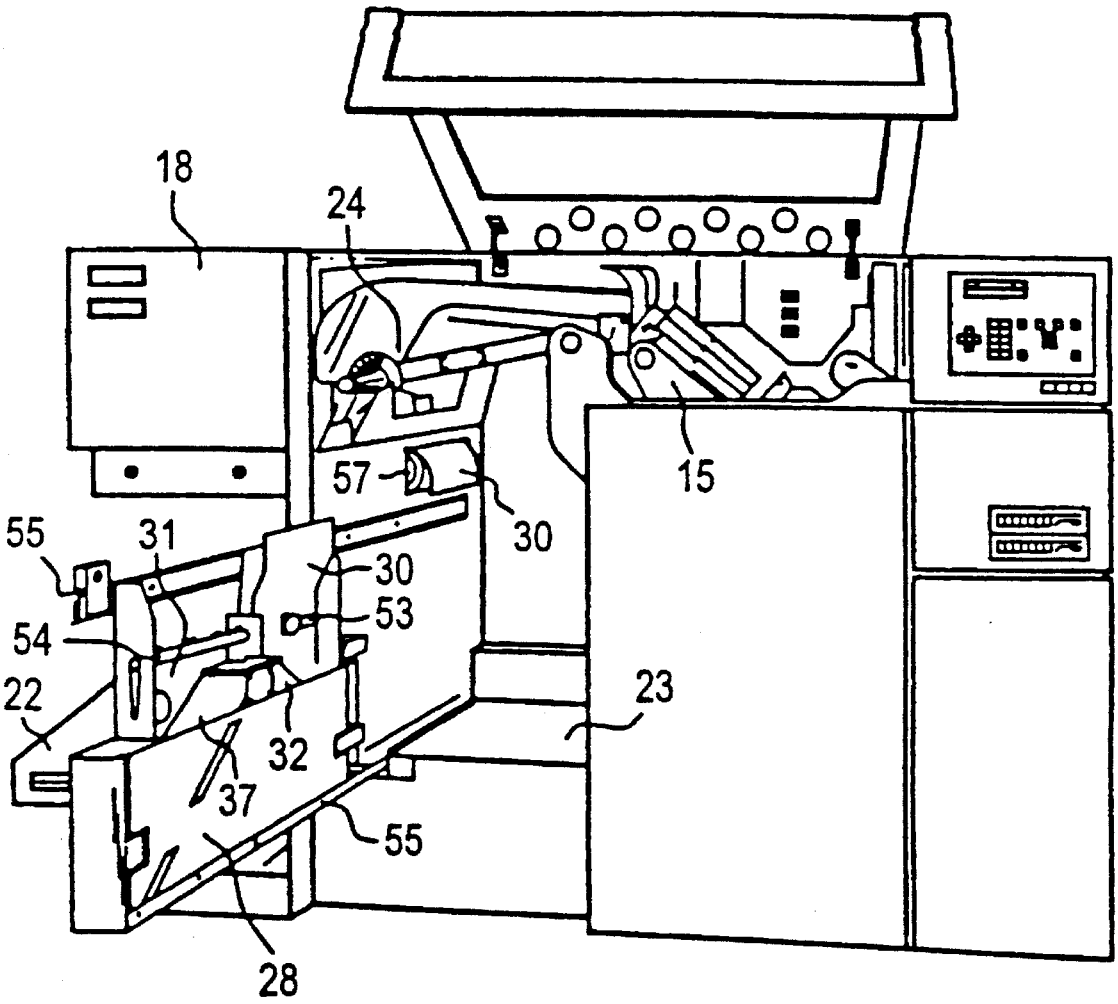
FIG. 17 is a schematic illustration of the turnover means in service position.
Figure 18:
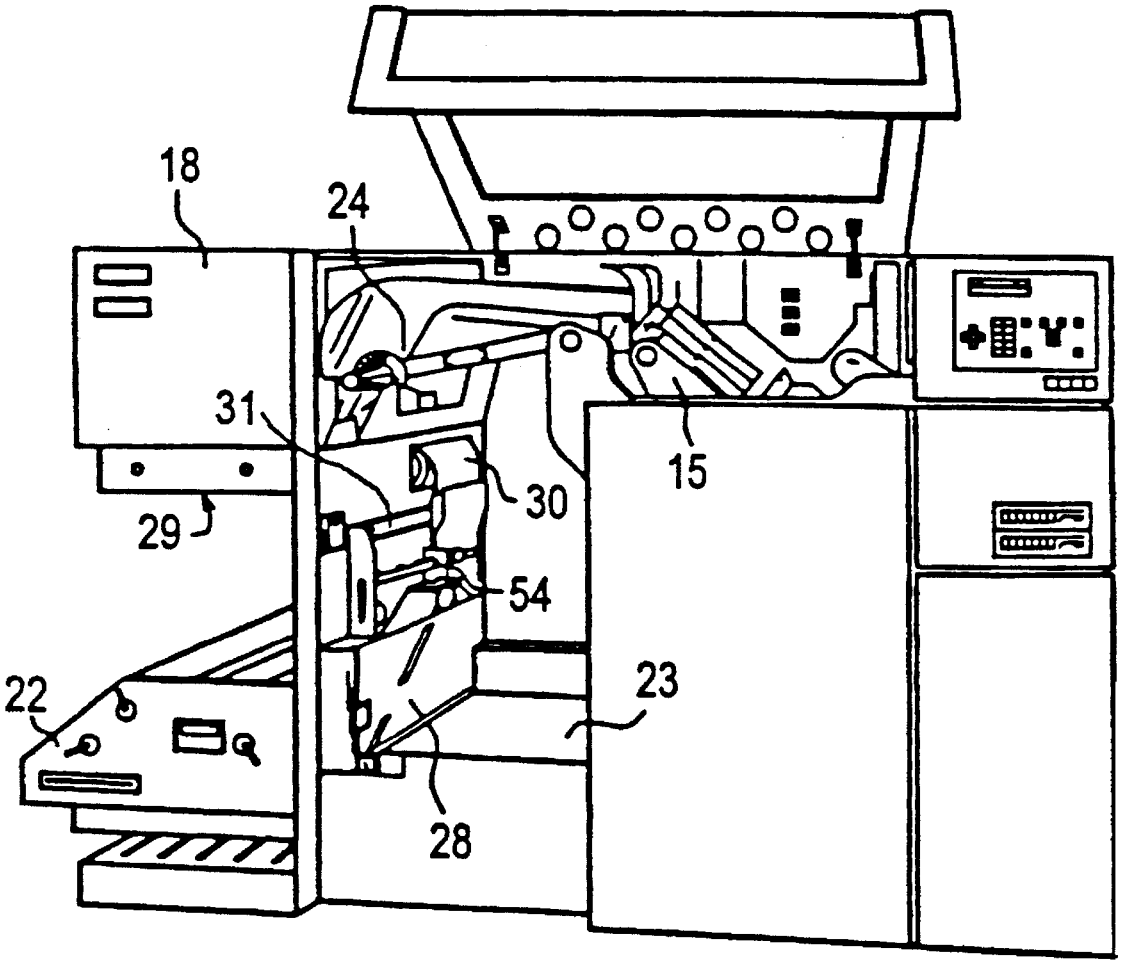
FIG. 18 is a schematic illustration of the turnover means in operating position.

The turnover device can be fashioned as an independent, torsionally stiff structural unit and can be seated in the apparatus removable therefrom on telescoping rails 55 (FIGS. 17, 18). All deflector elements are thus freely accessible given malfunctions in the paper running and in case of service.

FUNCTION OF THE TURNOVER MEANS

Figure 8:
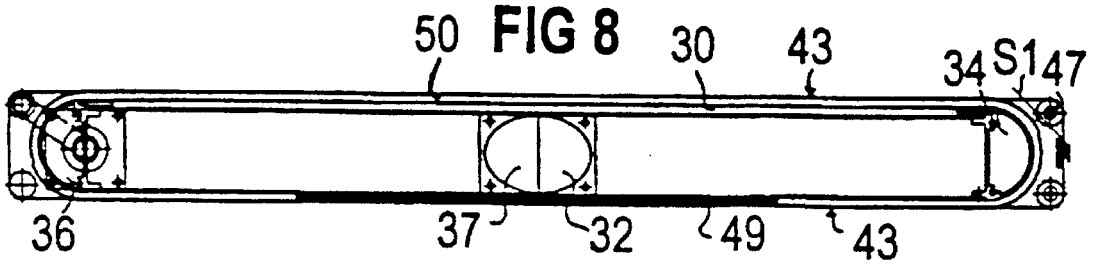
FIGS. 8–10 are schematic, sectional views of the threading process of the recording medium into the turnover means along the line of section A—A of FIG. 3.
Figure 9:
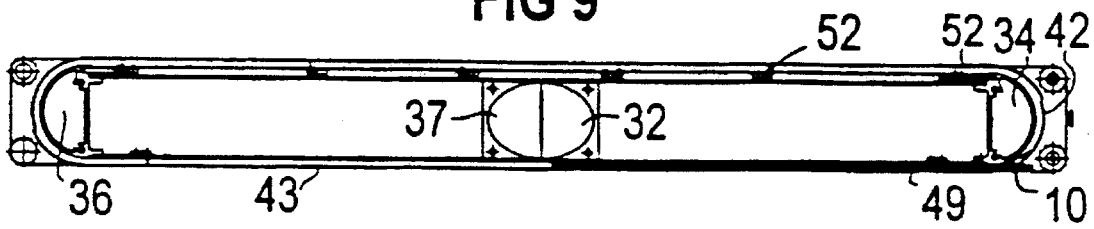
Figure 10:
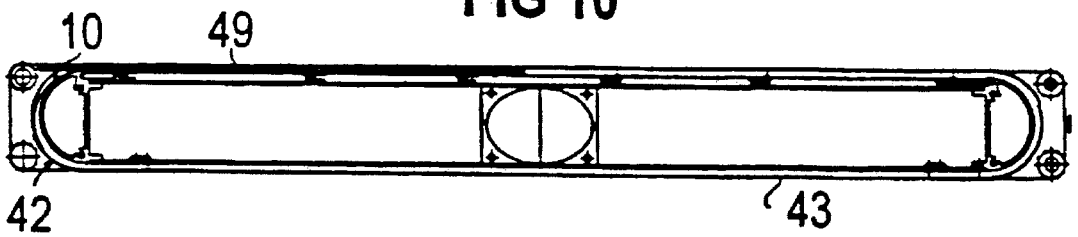
Figure 12:
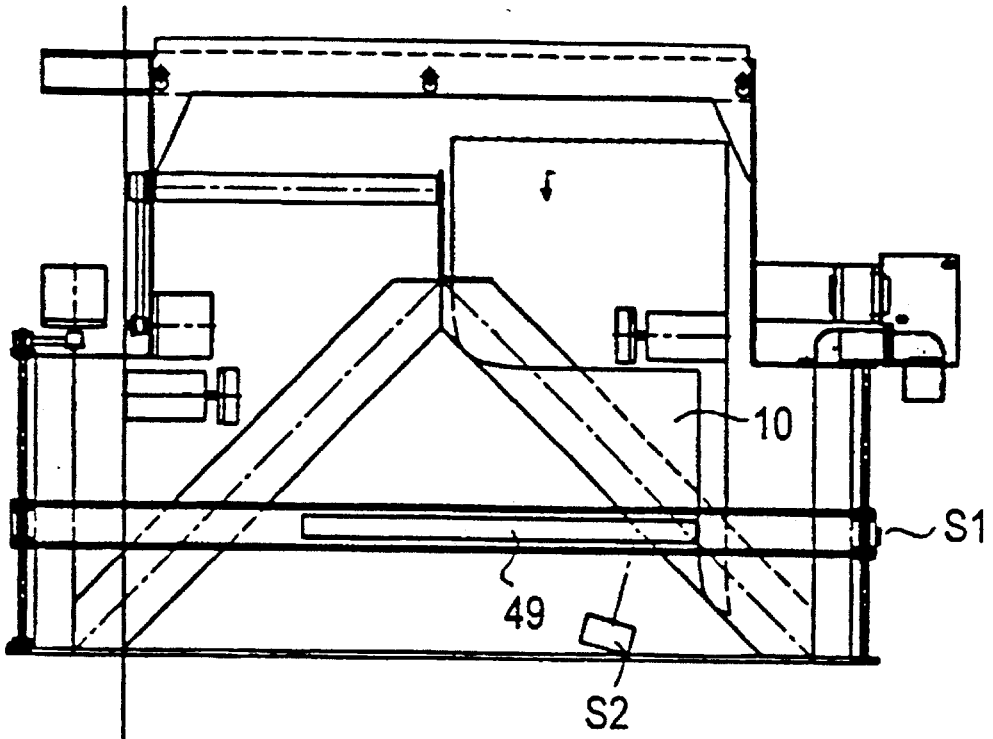
FIGS. 11–15 are schematic illustrations of the threading process of the recording medium into the turnover means.
Figure 11:
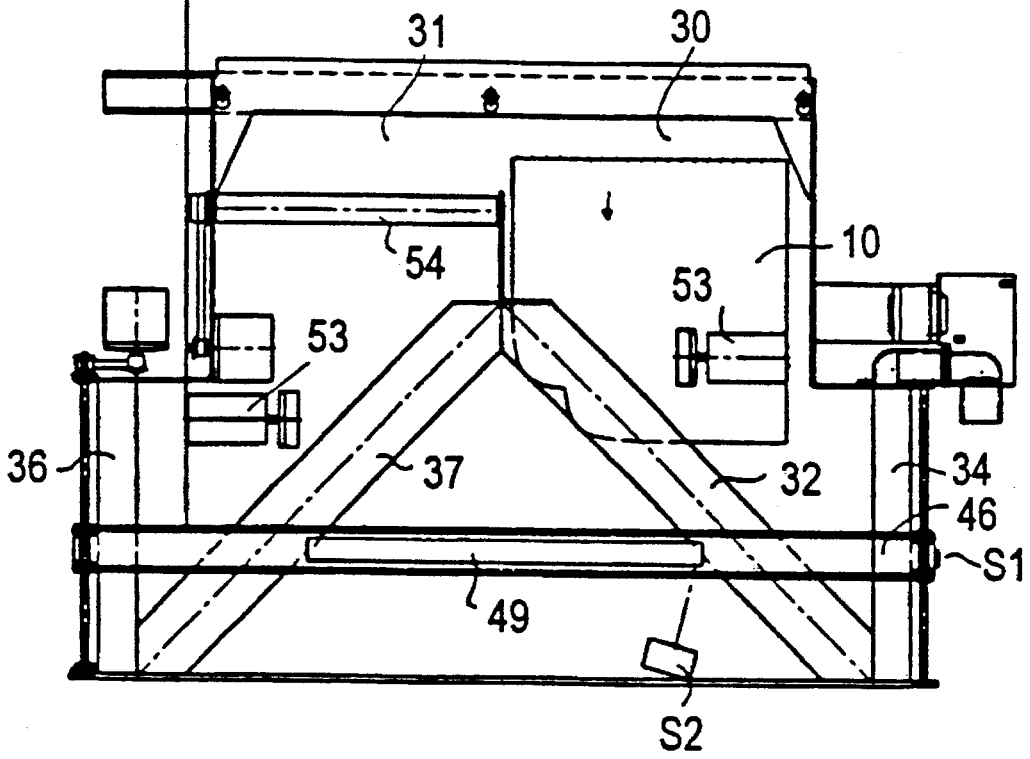
Figure 14:
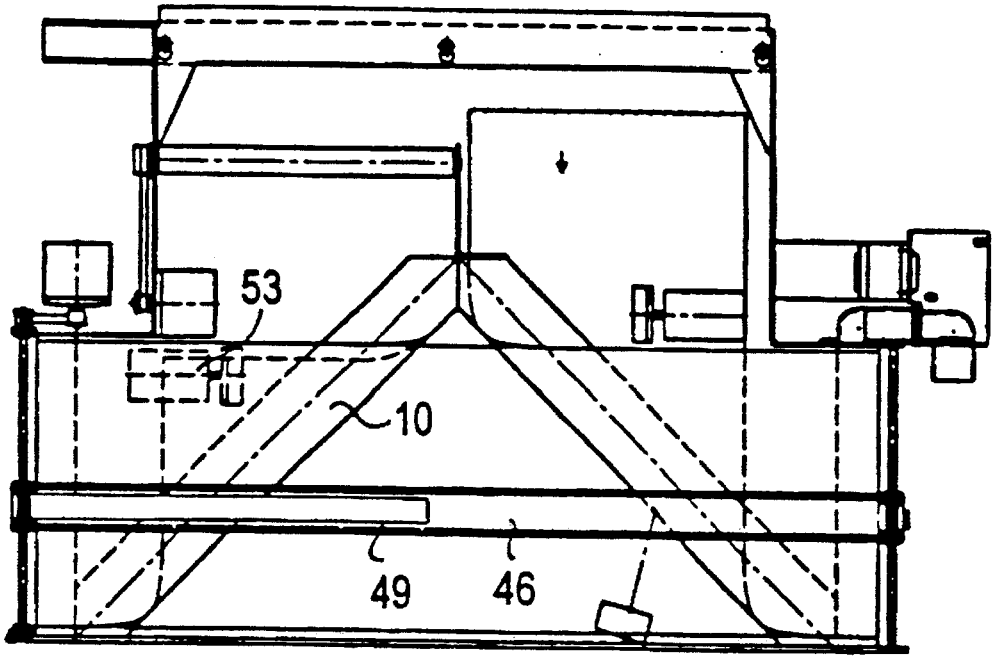
Figure 13:
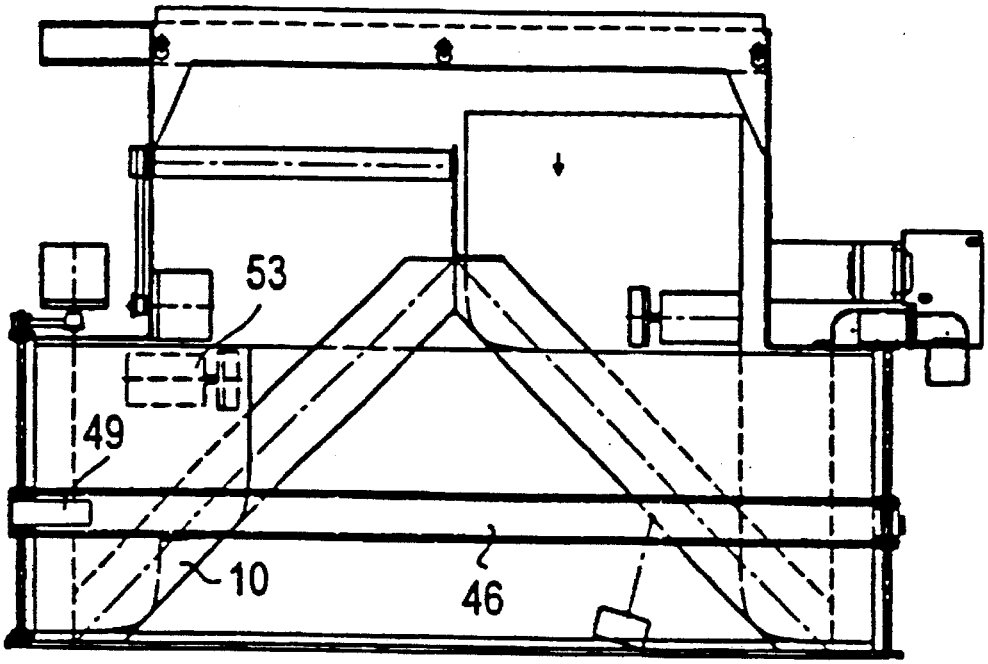
Figure 15:
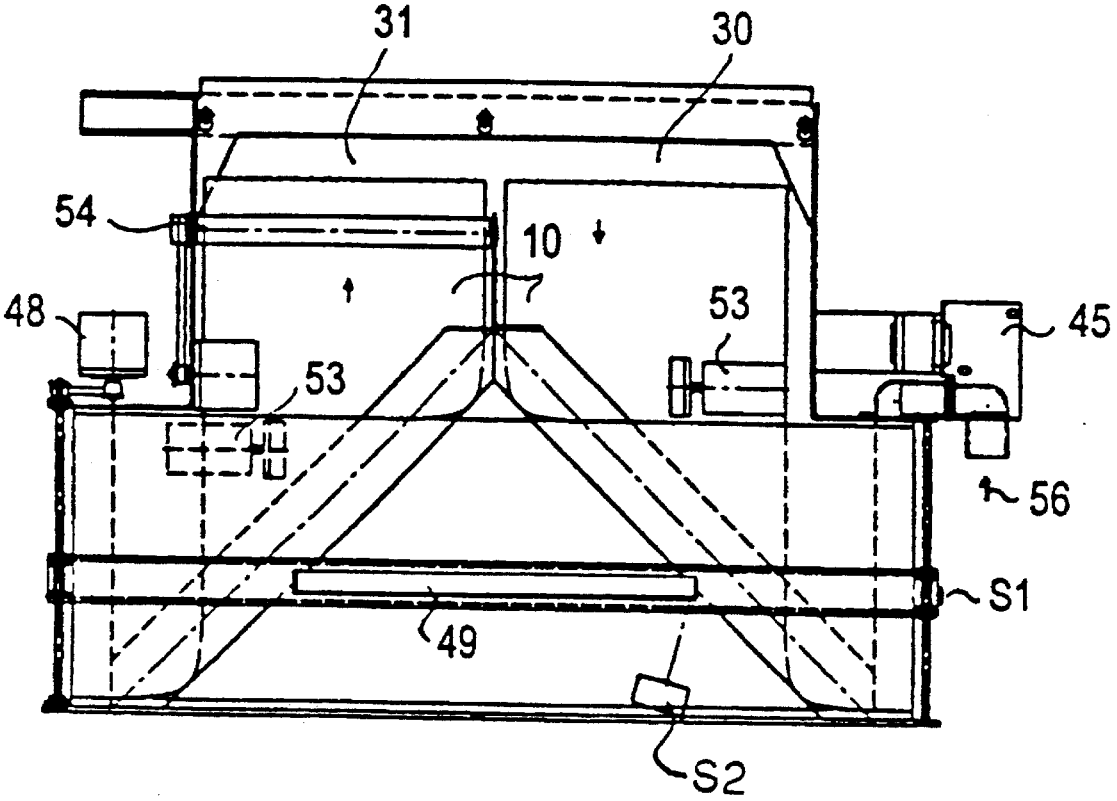

For the automatic threading of the recording medium through the turnover means, the blower for generating the blast air 56, the drives for the paper conveying elements 53 and for the paper conveying rollers 54 are activated by the threading control arrangement ZS. The friction coat 49 is located in the quiescent position between the oblique deflector elements 32, 37 shown in FIGS. 8 and 11. The start of the web entering via the paper admission channel is deflected in the deflection channel 39 of the first oblique deflector device 32 and is recognized via the sensor S2. As a result thereof, the conveyor belt 46 is started. It seizes the start of the web (FIG. 12) via the friction coat 49 and conveys it around the first reverser 34 (FIGS. 9, 12). The start of the recording medium thereby leads the friction coat 49 somewhat. After this, the recording medium start runs around the second reverser 36 and thereby again somewhat leads the friction coat 49 (FIGS. 10, 13). The start of the recording medium is then pushed with the back end of the friction coat 49 via the shunt 51 through the second oblique deflector 37 up into the region of the paper conveying element 53 (FIG. 14), is seized by the latter and is conveyed up into the region of the paper conveying rollers 54 (FIG. 15) and is further-conveyed from this latter point to the transfer printing station. The threading procedure has thus been ended and the friction coat is again disengaged from the recording medium in the quiescent position (FIGS. 8, 11).

Figure 2:
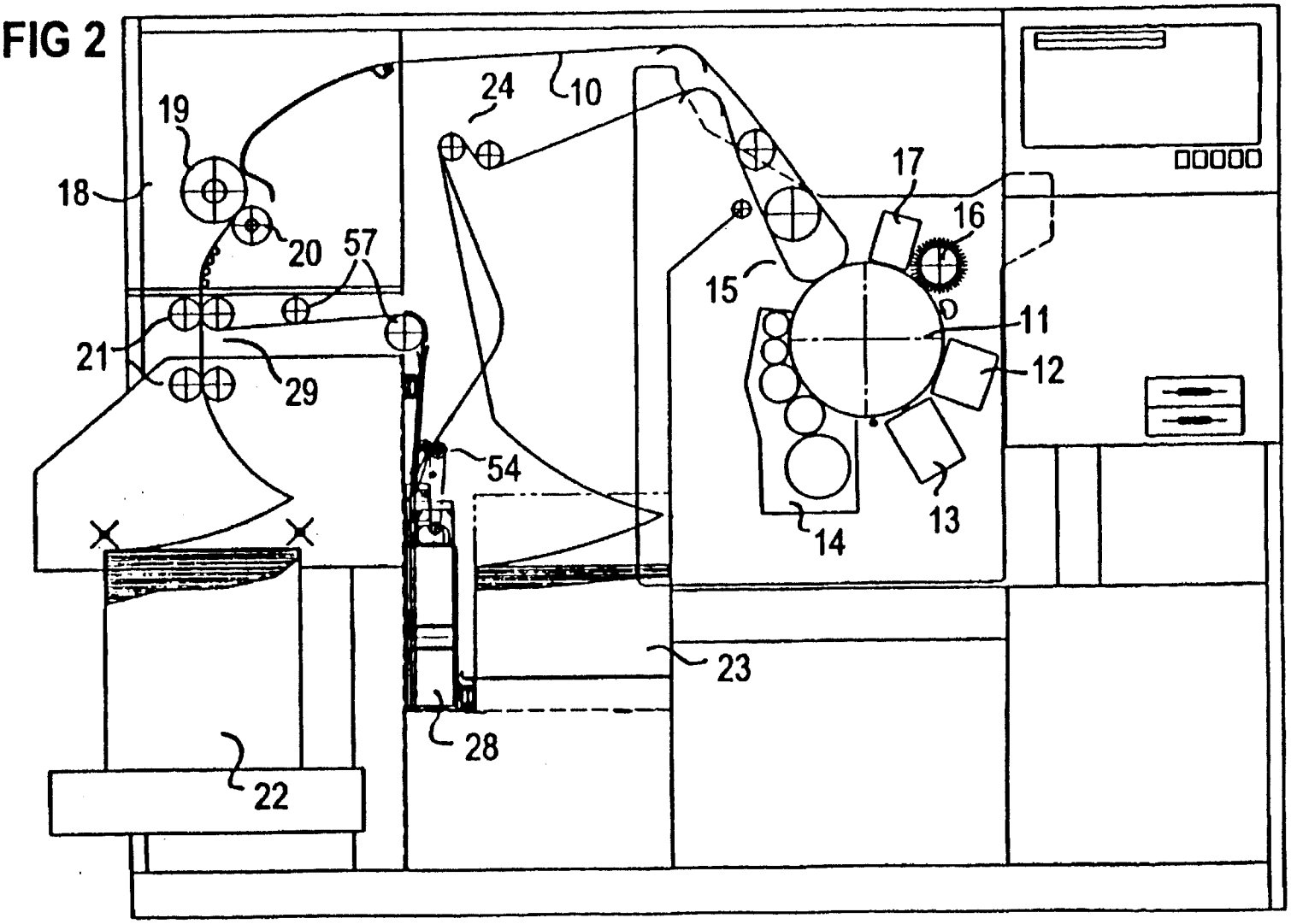
FIG. 2 is a schematic sectional view of the same electrographic printer means.

The paper admission channel 30 of the turnover means 28 can be coupled via paper conveyor elements 57 to a recording medium output channel 29 (FIG. 2) allocated to the fixing station 18 that comprises a useable width of at least twice the web width of the recording medium 10. As a result thereof, it is also possible to resupply the recording medium 10 unturned to the transfer printing station 15 with the required offset via the rollers 24 and to thus, for example, produce two-color superimposed color printing. To this end, the developer station 14 can comprise two separate developer regions 14/1, 14/2 for, example, red and black toner.

In the illustrated exemplary embodiment, the gripper element with the gripper means is composed of a conveyor belt 46 having a friction coat 49 arranged thereon. It is also possible to employ a mechanical clamp element or a friction member that is moved via traction means. Instead of the start/stop operation of the conveyor belt or, respectively, of the friction coat, the conveyor belt can also be continuously moved around the reversing devices corresponding to the conveying speed of the recording medium, whereby the friction coat remains in constant engagement with the recording medium.

The function of the paper admission channel can also be assumed by the paper discharge channel and vice versa, i.e. that the turnover means can be operated in two conveying directions.

It should be understood that various changes and modifications will be apparent to those skilled in the art. Such changes and modifications may be made without departing from the spirit and scope of the present invention and without diminishing its attendant advantages. Therefore, the appended claims are intended to cover such changes and modifications.

What is claimed is:

1. A turnover device for turning over a web-shaped recording medium, the device comprising:

an admission channel and a discharge channel arranged next to each other;

a first oblique deflector that laterally deflects the recording medium supplied through the admission channel in a conveying direction;

a first reverser following the first oblique deflector in the conveying direction for returning the recording medium behind the channels toward a second reverser arranged approximately parallel to the first reverser, the second reverser again reversing the recording medium;

a second oblique deflector that follows the second reverser, the second oblique deflector deflecting the recording medium into the discharge channel; and a threader for the threading the recording medium through the turnover device, the threader comprising a motor-driven friction element guided around the reversers, the friction element gripping a start of the recording medium by seizing said start of the recording medium in the region of the first oblique deflector, and guiding the recording medium around the reversers and the second oblique deflector and into the region of the discharge channel.

2. The turnover device according to claim 1, wherein the threader comprises:

a conveyor belt that wraps the reversing devices, at an inside of which the friction element is disposed.

3. The turnover device according to claim 1, wherein the friction element has a length such that the friction element is disengaged from the recording medium in an operating position at which the friction element is located between the oblique deflector devices.

4. The turnover device according to claim 1, further comprising: a plurality of paper conveyor elements, at least one being arranged in the paper admission channel conveying the start of the recording medium to the first oblique deflector device, and at least one other arranged in the discharge channel conveying the start of the recording medium from the second oblique deflector device to the discharge channel.

5. The turnover device according to claim 1, wherein the turnover device is an independent module removably mounted on a displaceable mount.

6. The turnover device according to claim 1, wherein the turnover device is arrangable in an electrographic printer for printing web-shaped recording media, the printer having:

an intermediate carrier with appertaining units producing toner images on the intermediate carrier;

a transfer printing station associated with the intermediate carrier and accepting the recording medium;

a fixing station following the transfer printing station in a conveying direction of the recording medium fixing the toner images on the recording medium, the intermediate carrier, transfer printing station and fixing station each has a useable width at least twice a web width of the recording medium, and the turnover device being arrangable to receive the recording media from the fixing station and to provide the recording medium to the transfer printing station from the paper discharge channel.

7. A turnover device for turning over a web-shaped recording medium, the device comprising:

an admission channel and a discharge channel arranged next to each other;

a first oblique deflector that laterally deflects the recording medium supplied through the admission channel in a conveying direction;

a first reverser following the first oblique deflector in the conveying direction for returning the recording medium behind the channels toward a second reverser arranged approximately parallel to the first reverser, the second reverser again reversing the recording medium;

a second oblique deflector that follows the second reverser, the second oblique deflector deflecting the recording medium into the discharge channel; and a threader for the threading the recording medium through the turnover device, the threader comprising a motor-driven gripper element guided around the reversers, the gripper element gripping a start of the recording medium by seizing said start of the recording medium in the region of the first oblique deflector, and guiding the recording medium around the reversers and the second oblique deflector and into the region of the discharge channel;

wherein each oblique deflector and reverser comprises a smooth deflector surface over which the recording medium glides, the deflector surface being faced by a concave guide surface at a distance, a deflection channel being defined between the deflector surface and guide surface.

8. The turnover device according to claim 7 wherein at least one guide surface is hingeably mounted to provide access to the respective deflector surface.

9. The turnover device according to claim 7, wherein each deflector surface further comprises:

air exit openings arranged in the region of the deflection surfaces, said openings being in communication with an air supply.

10. The turnover device according to claim 9, whereby each oblique deflector and reverser comprises a hollow tubular member with a hollow portion, the hollow portions being coupled in fluid communication with one another and to the common air supply.

11. A turnover device for turning over a web-shaped recording medium, the device comprising:

an admission channel and a discharge channel arranged next to each other;

a first oblique deflector that laterally deflects the recording medium supplied through the admission channel in a conveying direction;

a first reverser following the first oblique deflector in the conveying direction for returning the recording medium behind the channels toward a second reverser arranged approximately parallel to the first reverser, the second reverser again reversing the recording medium;

a second oblique deflector that follows the second reverser, the second oblique deflector deflecting the recording medium into the discharge channel;

a threader for the threading the recording medium through the turnover device, the threader comprising a motor-driven gripper element guided around the reversers, the gripper element gripping a start of the recording medium by seizing said start of the recording medium in the region of the first oblique deflector, and guiding the recording medium around the reversers and the second oblique deflector and into the region of the discharge channel;

a recording medium circulation channel guided around the reversers; and a shunt associated with each deflector for guiding the recording medium toward the respective deflector and wherein the gripper element is guided in a recording medium circulation channel extending between the reversers.

12. A turnover device for turning over a web-shaped recording medium, the device comprising:

an admission channel and a discharge channel arranged next to each other;

a first oblique deflector that laterally deflects the recording medium supplied through the admission channel in a conveying direction;

a first reverser following the first oblique deflector in the conveying direction for returning the recording medium behind the channels toward a second reverser arrange approximately parallel to the first reverser, the second reverser again reversing the recording medium;

a second oblique deflector that follows the second reverser, the second oblique deflector deflecting the recording medium into the discharge channel; and a threader for the threading the recording medium through the turnover device, the threader comprising a motor-driven gripper element guided around the reversers, the gripper element gripping a start of the recording medium by seizing said start of the recording medium in the region of the first oblique deflector, and guiding the recording medium around the reversers and the second oblique deflector and into the region of the discharge channel;

whereby the gripper element is guided around the reversers over a conveying path that is longer than a conveying path of the start of the recording medium so that the start of the recording medium leads relative to the gripper element when circulating around the reversing devices.

13. A turnover device for turning over a web-shaped recording medium, the device comprising:

an admission channel and a discharge channel arranged next to each other;

a first oblique deflector that laterally deflects the recording medium supplied through the admission channel in a conveying direction; a first reverser following the first oblique deflector in the conveying direction for returning the recording medium behind the channels toward a second reverser arranged approximately parallel to the first reverser, the second reverser again reversing the recording medium;

a second oblique deflector that follows the second reverser, the second oblique deflector deflecting the recording medium into the discharge channel;

a threader for the threading the recording medium through the turnover device, the threader comprising a motor-driven gripper element guided around the reversers, the gripper element gripping a start of the recording medium by seizing said start of the recording medium in the region of the first oblique deflector, and guiding the recording medium around the reversers and the second oblique deflector and into the region of the discharge channel; and a plurality of paper conveyor elements, at least one being arranged in the paper admission channel conveying the start of the recording medium to the first oblique deflector device, and at least one other arranged in the discharge channel conveying the start of the recording medium from the second oblique deflector device to the discharge channel;

wherein a conveyor element is arranged downstream from the second oblique deflector.

14. A turnover device for turning over a web-shaped recording medium, the device comprising:

an admission channel and a discharge channel arranged next to each other;

a first oblique deflector that laterally deflects the recording medium supplied through the admission channel in a conveying direction;

a first reverser following the first oblique deflector in the conveying direction for returning the recording medium behind the channels toward a second reverser arranged approximately parallel to the first reverser, the second reverser again reversing the recording medium;

a second oblique deflector that follows the second reverser, the second oblique deflector deflecting the recording medium into the discharge channel;

a threader for the threading the recording medium through the turnover device, the threader comprising a motor-driven gripper element guided around the reversers, the gripper element gripping a start of the recording medium by seizing said start of the recording medium in the region of the first oblique deflector, and guiding the recording medium around the reversers and the second oblique deflector and into the region of the discharge channel;

a first sensor sensing the position of the gripper element;

a second sensor sensing a presence of the recording medium near the first oblique deflector; and a threading control arrangement operably coupled with the sensors and the recording medium conveyor means, said control arrangement controlling threading of the start of the recording medium, causing the start of the recording medium to be seized when sensed by the second sensor in the region of the first oblique deflector device, activating the threading of the recording medium until the start of the recording medium extends into the paper discharge channel, positioning the gripper element in a quiescent position where it is disengaged from the recording medium.

15. A turnover device for turning over a web-shaped recording medium, the device comprising:

an admission channel and a discharge channel arranged next to each other;

a first oblique deflector that laterally deflects the recording medium supplied through the admission channel in a conveying direction;

a first reverser following the first oblique deflector in the conveying direction for returning the recording medium behind the channels toward a second reverser arranaged approximately parallel to the first reverser, the second reverser gain reversing the recording medium;

a second oblique deflector that follows the second reverser, the second oblique deflector deflecting the recording medium into the discharge channel; and a threader for the threading the recording medium through the turnover device, the threader comprising a motor-driven gripper element guided around the reversers, the gripper element gripping a start of the recording medium by seizing said start of the recording medium in the region of the first oblique deflector, and guiding the recording medium around the reversers and the second oblique deflector and into the region of the discharge channel wherein the turnover device is arrangable in an electrographic printer for printing web-shaped recording media, the printer having:

an intermediate carrier with appertaining units producing toner images on the intermediate carrier;

a transfer printing station associated with the intermediate carrier and accepting the recording medium;

a fixing station following the transfer printing station in a conveying direction of the recording medium fixing the toner images on the recording medium, the intermediate carrier, transfer printing station and fixing station each has a useable width at least twice a web width of the recording medium, and the turnover device being arrangable to receive the recording media from the fixing station and to provide the recording medium to the transfer printing station from the paper discharge channel; and wherein the paper admission channel receives said recording medium from a recording medium output channel, the output channel having a width of at least twice a web width of the recording medium, the recording medium being driven via paper conveyor elements.

16. A turnover device for a turning over a continuous paper conveyed generally longitudinally, the turnover device comprising:

a paper admission slot through which the paper is delivered;

a paper discharge slot parallel to the paper admission slot and axially disposed therewith;

a W-shaped arrangement of rods including:

a first deflector rod arranged at approximately forty-five degrees from the paper admission slot, the paper being conveyed from the admission slot gliding over the deflector rod and away therefrom so that the paper changes direction at a right angle;

a first reverser rod arranged at a first side of the turnover device approximately ninety degrees from the admission slot, the first reverser rod receiving the paper from the first deflector rod, the paper gliding around the first reverser rod and reversing its direction;

a second reverser rod arranged parallel to the first reverser rod at an opposite side of the turnover device, the second reverser rod receiving paper conveyed from the first reverser rod, the paper gliding over around the second reverser rod and reversing its direction;

a second deflector rod arranged approximately forty-five degrees from the admission slot, the paper conveyed from the second reverser rod gliding over the second deflector rod and away therefrom so that the paper changes direction at a right angle, paper being conveyed away from the second deflector rod through the discharge slot, the paper exiting the discharge slot in a flipped over manner relative to the paper entering the admission slot; and a threader including:

a conveyor belt extending in a continuous manner around the first and second reverser rods;

a gripping pad disposed on an inner side of the conveyor belt to engage and convey the paper from the first deflector rod, around the first and second reverser rods, and to the second deflector rod.

17. The turnover device according to claim 16 further comprising: a guide channel disposed over each deflector rod and reverser rod guiding the paper thereover.

18. The turnover device according to claim 16 further comprising: a hollow cavity within at least one said rod; and air holes through said rod associated with each hollow cavity, the air holes being in communication with an air supply and forming an air pillow between said rod and said paper.

19. The turnover device according to claim 16 further comprising:

a threader controller; and a first sensor sensing a presence of the paper inserted near the first deflector rod;

a second sensor sensing the position of the friction pad;

wherein the controller activates the conveyor belt in response to a signal from the first sensor, causing the paper to be conveyed through the turnover device and threaded around said rods, and wherein the friction pad is stopped in a position not engaging the paper after the paper has been threaded to the discharge slot.

* * * * *